United States Patent [19]

Harris

[11] 4,365,734

[45] Dec. 28, 1982

[54] SPLICING MACHINE AND METHOD

[75] Inventor: Roderick E. Harris, Miami, Fla.

[73] Assignee: Gang-Nail Systems, Inc., Miami, Fla.

[21] Appl. No.: 127,033

[22] Filed: Mar. 4, 1980

[51] Int. Cl.[3] ..... B27F 7/15

[52] U.S. Cl. ..... 227/152; 100/913

[58] Field of Search ..... 100/233, 264, 272, DIG. 13; 227/152

[56] References Cited

U.S. PATENT DOCUMENTS

| | | | |
|---|---|---|---|
| 38,767 | 6/1863 | Stein | 100/264 |
| 692,262 | 2/1902 | Geering | 100/264 |
| 788,968 | 5/1905 | Walker | 100/264 X |
| 1,230,709 | 6/1917 | Hill | 100/272 X |
| 1,257,558 | 2/1918 | Webb | 100/233 X |
| 3,170,322 | 2/1965 | Cavanaugh | 100/264 X |
| 3,315,595 | 4/1967 | Moehlenpah et al. | 100/913 |
| 3,402,869 | 9/1968 | Otis | 100/913 |
| 3,901,141 | 8/1975 | Bochmann | 100/204 X |
| 4,054,280 | 10/1977 | Alberts | 227/152 X |

*Primary Examiner*—Paul A. Bell

*Attorney, Agent, or Firm*—LeBlanc, Nolan, Shur & Nies

[57] ABSTRACT

A method and machine for applying multiple nail fasteners to bridge a butt joint between members, the machine comprising a frame and side by side lever arms having fastener mounting platens with magnets on one pair of adjacent ends and having the other pair of adjacent ends connected to a fluid pressure motor mounted on the frame, so that the motor may be actuated to simultaneously rock both arms between one position wherein the one pair of adjacent ends is separated for mounting the fasteners thereon and another position wherein the arms are rocked to drive said fasteners into the members disposed between them at the joint.

6 Claims, 15 Drawing Figures

SPLICING MACHINE AND METHOD

This invention relates to the splicing together of wooden piling and like sections in end to end abutment and is particularly concerned with a method and machine for effecting the same.

The invention will be described in its preferred embodiment where a piling section is spliced to the end of another piling section that has for example already been partly driven into a surface, whereby a substantially continuous piling assembly may be attained.

Prior to the invention it was usual to effect continuation of a piling assembly of this type by providing a metal sheath closely enclosing both piling sections and bridging the butt joint between piling sections, sometimes with nails driven through the sheath where the sheet may have prepunched holes or may be pierced by a sharp fastener.

In the present invention the piling sections are placed in end to end abutment and a plurality of multiple nail plates are quickly applied to bridge the butt join and penetrate the piling surface, and this method of splicing and a novel machine for effecting the same constitute the major object of the invention.

A further object of the invention is to provide a novel method of splicing end abutting wooden piling and like members wherein a plurality of opposed multiple nail plates simultaneously penetrate the members in bridging relation to the butt joint.

It is a further object of the invention to provide a novel portable machine for applying multiple nail plates to splice piling and like abutting members in situ.

A further object of the invention is to provide a novel machine for applying multiple nail plates to a wooden or like member wherein a multiple nail plate is releasably mounted on one end of an intermedially pivoted lever arm and power is applied to the other end of the lever arm to rock the lever arm quickly and with sufficient force to drive the nails of the multiple nail plate to penetrate the member. Pursuant to this object the multiple nail plate may be held on the arm by magnetic means.

Another object of the invention is to provide a novel machine wherein two side by side lever arms are intermedially pivoted on a frame, the arms are connected at adjacent one ends by a toggle linkage motivated by a motor for rocking the arms between two predetermined relative positions, and the arms at the adjacent other ends are provided with fastener holding means that face each other in the machine. Further to this object the fasteners may be ferrous metal multiple nail plates or the like and the holding means may be magnets on the lever arms.

PREFERRED EMBODIMENTS

Figure 1:
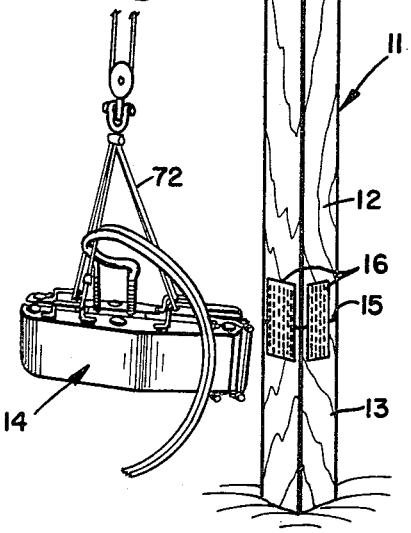
FIG. 1 is a generally perpsective view showing a machine according to a preferred embodiment of the invention in a use location.

FIG. 1 shows a wooden pile assembly 11 consisting of two equal cross section wooden pile sections 12 and 13. The lower section 13 has already been driven into the ground far enough to leave upstanding a length of about two or three feet and the upper section 12 is placed on the lower section in end abutment at a butt joint 15. The invention comprises a portable machine 14 that may be moved to and about the butt joint 15 and operated for bridging the joint with metal multiple nail plates 16 to thereby splice the upper section to the lower section and effectively form a continuous pike which may be driven down well below the butt joint.

Each multiple nail plate 16 is of steel and exhibits at one side a multiplicity of integral pointed end nails 17 projecting substantially perpendicularly, the nails preferably being formed by striking out sections of a flat plate blank. A multiple nail plate of this type is disclosed in Jureit U.S. Pat. No. 3,390,902 but the invention is not limited to this particular design. Where the pile sections are flat sided, flat plates 16 are used. For circular cross section pile sections the platens carrying plates 16 may be narrow and curved to suit the piling surfaces.

Figure 13:
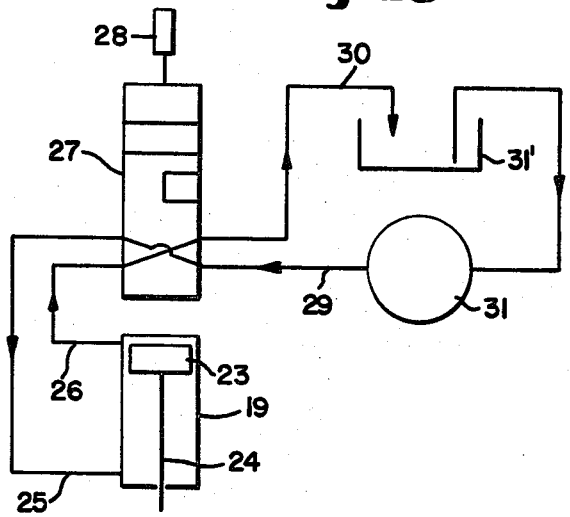
FIGS. 13, 14 and 15 are diagrammatic views showing different operational conditions in the hydraulic circuit.
Figure 14:
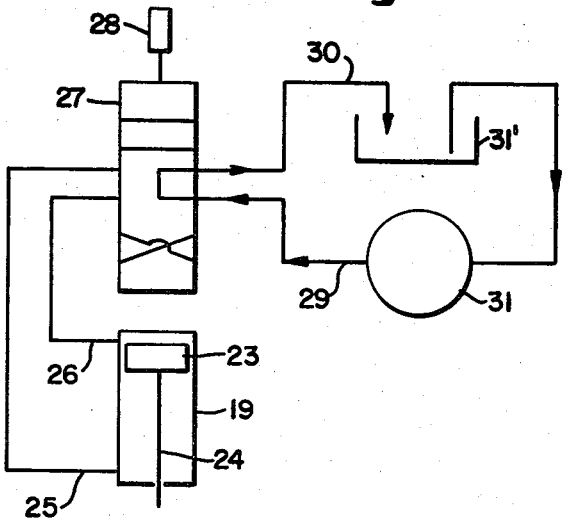
Figure 15:
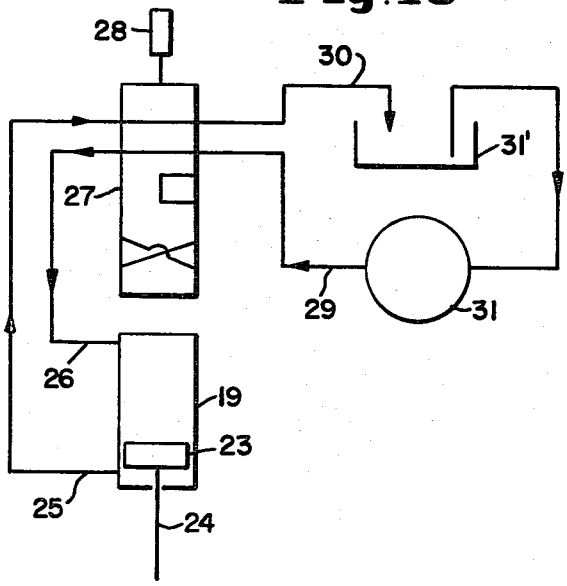

Machine 14 comprises a central frame member 18 on which is secured a longitudinally extending hydraulic motor cylinder 19 having port openings 21 and 22 at opposite ends of the cylinder, and a slidable piston 23 fixed on a reciprocable piston rod 24. Hydraulic fluid conduits 25 and 26 extend from these ports to a reversible valve 27 having a manual operator 28 and an input line 29 connected to a suitable source of hydraulic fluid under pressure such as pump 31. As shown in FIGS. 13–15 pump 31 has its inlet connected to a sump or tank 31' that also is connected to a hydraulic fluid return line 30.

Figure 7:
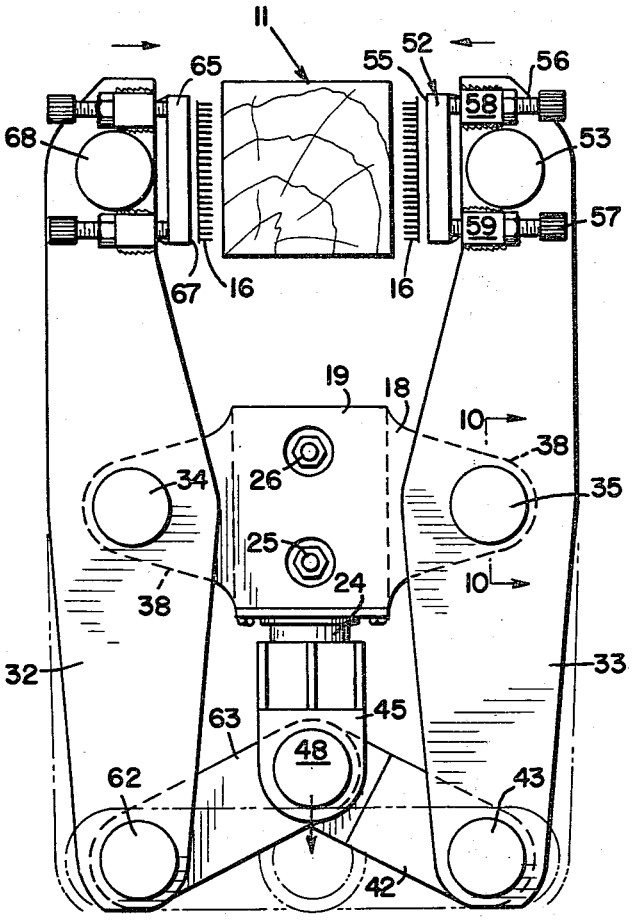
FIG. 7 is a top plan view somewhat diagrammatic showing the major components of the machine.
Figure 9:
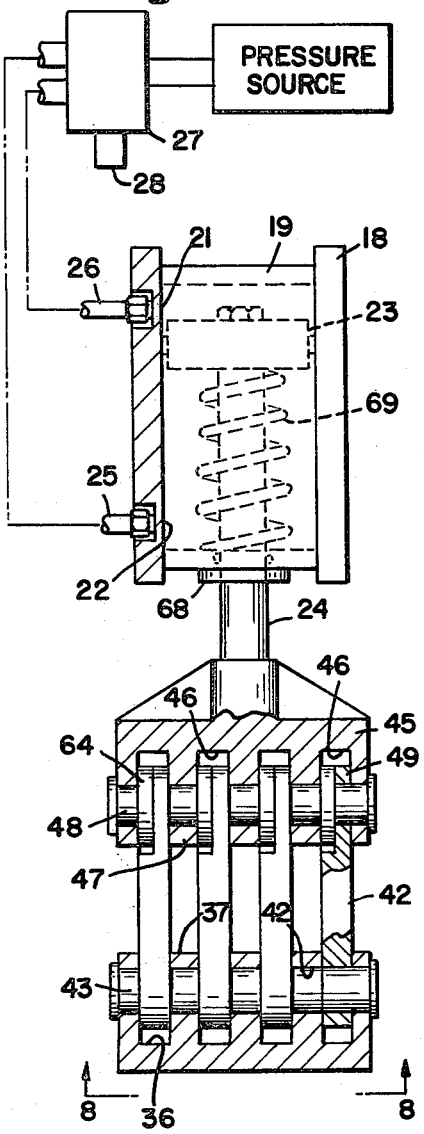
FIG. 9 is a somewhat diagrammatic view partly in section for illustrating operation of the machine.
Figure 8:
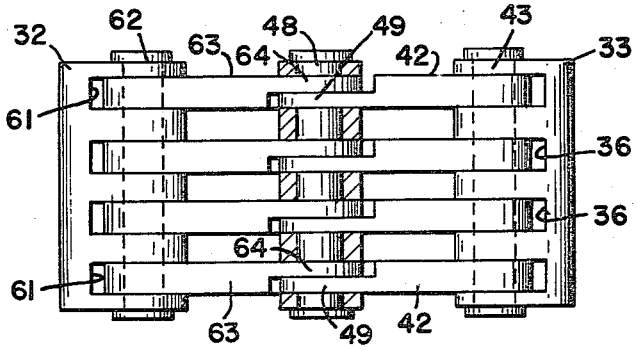
FIG. 8 is an end view showing the toggle linkage of the machine of FIG. 7.

In FIGS. 9 and 13 the motor is shown in piston retracted position, the platen end of the device being open as shown in FIG. 7. The valve 27 is so positioned as to connect conduits 25 and 26 to the hydraulic fluid input and output lines 29 and 30 respectively, and since pump 31 will be operating the piston will be moved to and held in the piston rod retracted position shown.

In FIG. 15 the valve has been reversed to connect the pump input line and the return line to the opposite end of the motor cylinder, thereby driving the piston to the extended piston rod position shown there.

FIG. 14 shows an intermediate valve position wherein the valve 27 is moved to disconnect motor 19 from the source of hydraulic pressure, the fluid merely recirculating between the pump and tank when the pump is running. This position which is available whenever the piston rod has been retracted or extended effectively locks the fluid pressure in the motor and maintains the selected condition.

A pair of longitudinally extending similar sturdy lever arms 32 and 33 are pivoted intermediate their ends on the frame 18 on cylindrical pivot posts 34 and 35 respectively. The posts 34 and 35 are laterally aligned and have parallel axes that are perpendicular to the axis of piston rod 24. The axes of posts 34 and 35 are preferably equidistant from the axis of rod 24.

Figure 10:
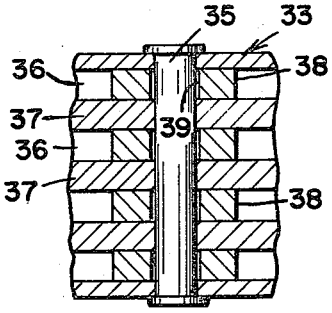
FIG. 10 is a fragmentary view mainly in section showing the rib and groove interconnection of the frame and each arm.

As shown in FIG. 10 arm 33 is formed with a plurality of internally facing parallel longitudinal grooves 36 spaced by ribs 37. The adjacent side of frame 18 is formed with a plurality of parallel ribs 38 each extending into a groove 36, each frame rib 38 having a bore 39 rotatably receiving post 35. The arm ribs 37 are preferably rigid with post 35.

One end of arm 33 is connected to the piston rod 24 by a stack of similar toggle links 42. As shown in FIG. 9 a pivot post 43 rigid with arm 33 extends through the ribs and grooves of the arm and rotatably through bores 44 in links 42.

Piston rod 24 has fixed to it a multiple clevis body 45 formed with a plurality of grooves 46 spaced by ribs 47. A pivot post 48 rigid with the clevis body passes through the grooves 46, and the adjacent reduced size ends 49 of the toggle links 42 extend into grooves 46 where they are formed with bores freely rotatably engaging post 48. Toggle ends 49 are half the width of a groove 46 for a purpose to appear. The axis of post 48 is longitudinally aligned with the axis of rod 24, and the axes of posts 35, 43 and 48 are parallel.

Figure 11:
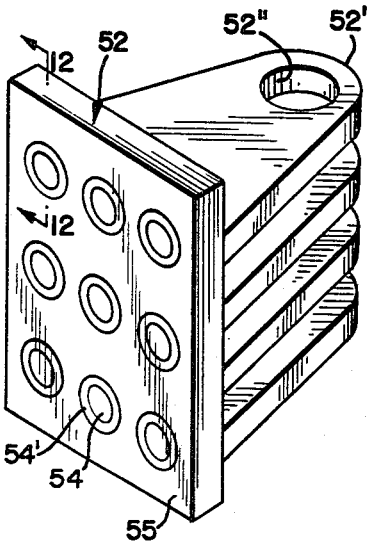
FIG. 11 is a fragmentary view showing a platen with imbedded magnets apart from the assembly.
Figure 12:
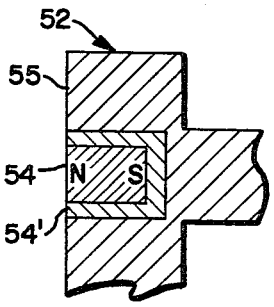
FIG. 12 is a fragmentary section illustrating magnet mounting.

At the other end of arm 33 a platen 52 shown apart in FIG. 11 is freely pivoted on a post 53 on an axis parallel to the other pivot post axes. Platen 52 has a plurality of rearwardly projecting ribs 52' extending in arm grooves 36 and formed with aligned bores 52'' through which post 53 passes. On its face platen 52 carries imbedded permanent magnets 54, the platen and magnets thus having a common flat surface 55. The north poles of each manget are at surface 55, and as shown in FIG. 12 each magnet is mounted in the platen by a magnetic isolation layer 54' of aluminum, brass or plastic. At opposite sides of post 53, which is fixed to arm 33, a pair of adjustable stops 56 and 57 comprising bolts threaded in lugs 58 and 59 rigid with arm 33 are adapted to abut the rear side of platen 52 to limit the self-leveling movement of the platen about the post during use of the machine as will appear.

Similarly arm 32 is formed with parallel longitudinal grooves 61 that receive the frame ribs 38 on the opposite side from arm 33 to the rotatably mounted on pivot post 34, whereby arm 32 mounts a pivot post 62 which like post 43 freely rotatably mounts a stack of toggle links 63. The other ends of links 63 are reduced to half width at 64 and extend into the grooves 46 of the clevis body to be rotatably mounted on post 48 in overlapping relation with the ends 49 of toggle links 42. A platen 65 identical with platen 52 carrying imbedded magnets 66 and having a flat face 67 is freely rotatably mounted on a pivot post 68 on arm 32 similarly and opposite to platen 52.

Arm 32 is essentially a mirror image of arm 33. Posts 34, 62 and 68 provide parallel pivot axes. The distance between posts 35 and 53 is equal to the distance between posts 34 and 68, and the distance between posts 35 and 43 is equal to the distance between posts 34 and 62. The toggle links 42 and 63 are all of the same effective length.

Valve 27 is of such character that it is normally disposed to introduce hydraulic fluid through line 25 to urge the parts to the FIG. 7 full line position wherein the toggle links are pulled to the inner side of the plane containing the axes of posts 43 and 62 and the effective jaw structure provided at the platen end of the machine is spread for maximum opening. A single ended hydraulic cylinder with appropriate connection to the hydraulic power source may be used to actuate the piston, in which case it may be desirable to put a light return spring 69 within the cylinder 19 to bias the parts to jaw open position when no power is applied to the cylinder.

In operation when it is desired to splice two pile sections together, the top pile section is placed in end abutment on the lower pile section and held there as by a crane, the contacting ends being in full surface contact. Multiple nail plates 16 are then placed on the opposing holding magnets, platen surfaces 55 and 67 so that the nails project toward each other, and then the machine is moved until the butt joint between the pile section is bridged and embraced by the swivel shoes, with the nails pointing at opposite surfaces of the pile assembly. The operator actuates the valve 27 to connect line 26 to the pressure source and line 25 to exhaust, which results in the motor 19 immediately pushing the post 48 outwardly and the toggle link to the dotted line position of FIG. 7. During this action the toggle ends of the arms 32 and 33 are forced rapidly laterally outwardly whereby the platens 52 and 65 are simultaneously rapidly forced laterally inwardly until the nails 17 penetrate the wooden pile structure and plates 16 are flush upon the pile surfaces. The jaw may be opened and the machine removed from the completely spliced joint by reversing valve 27, the magnetic force being less than the holding power of the driven nails. The platens 52 and 65 are moving in an arc while advancing toward the pile assembly but the slight rocking permitted each platen by the associated adjustable stop elements insures that plates 16 are parallel to the flat sides of the piling as the nails penetrate.

The motor 19 is of such power and the foregoing structure of such sturdiness that the splicing operation is speedy, accurate and efficient. The multiple nails hold the plates on the piling surfaces and the plates effectively sheath the piling assembly at the butt joint.

Figure 2:
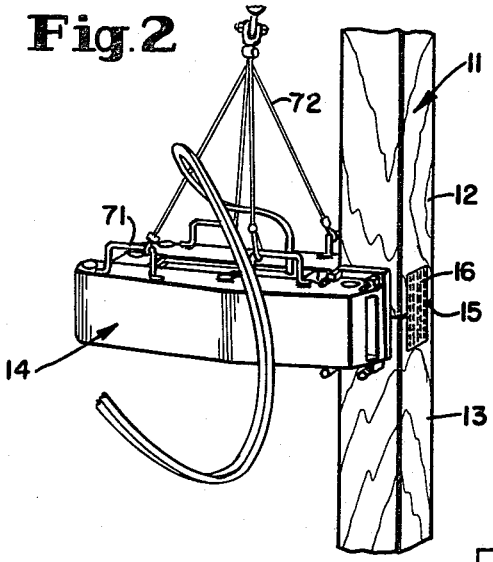
FIG. 2 is a generally perspective view showing the machine in position for splicing pile sections.
Figure 3:
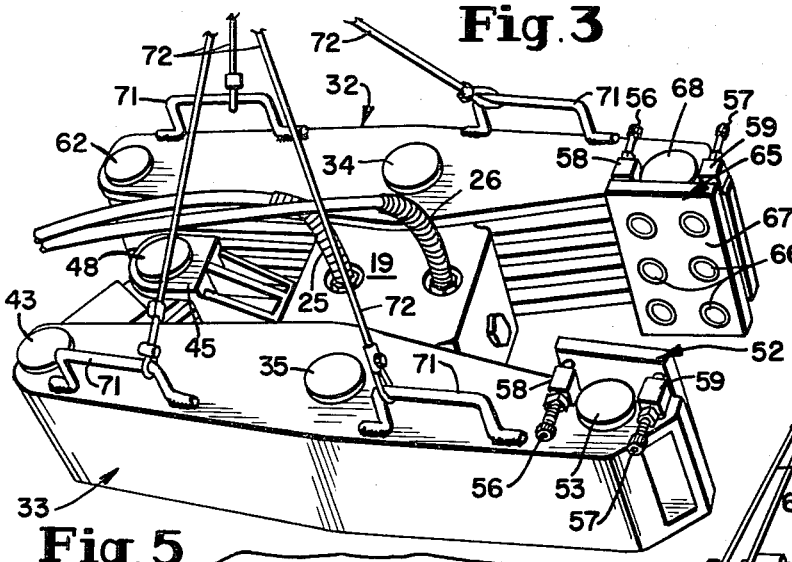
FIG. 3 is an enlarged photographic view showing the machine as it appears from above.
Figure 6:
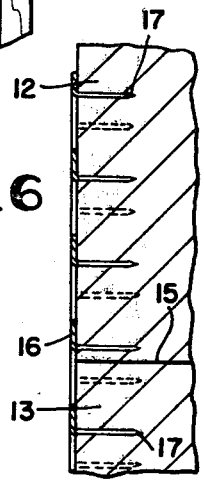
FIGS. 5 and 6 are fragmentary plan and side views respectively showing a multiple nail plate in position.
Figure 4:
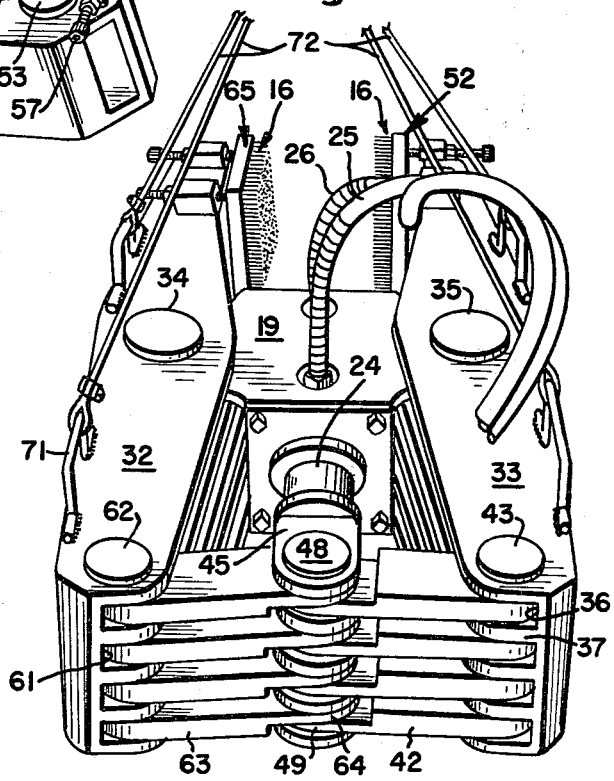
FIG. 4 is an enlarged photographic view showing the machine at the toggle end.
Figure 5:
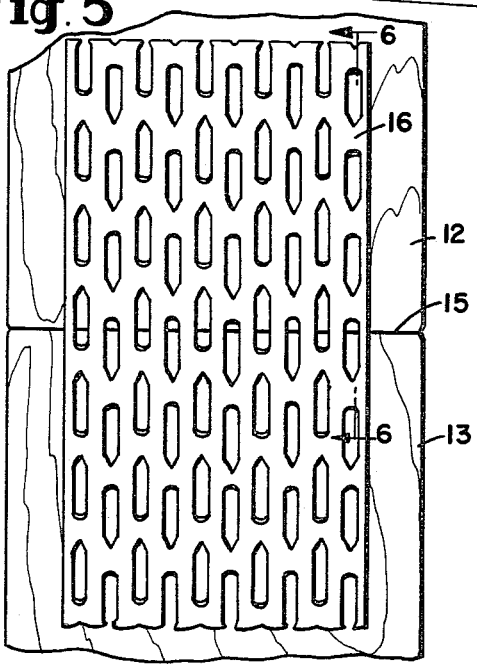

As shown in FIGS. 1–3 the machine is portable and the arms have fixed handles or mounting loops 71 thereon by which the machine may be effectively suspended on cables 72 from a block and tackle or a block and counterbalance arrangement and manipulated to operative position.

It has been found that spliced piling joints formed in this way exhibit improved resistance to bending and tensile stress, and increased resistance to any tension forces tending to pull the joint apart. For example in about six inch square cross section wooden pilings, as compared to tubular metal sheaths hitherto relied upon for splicing such joints, the multiple nail plate spliced joint showed a resistance in bending up to 2800 pound feet as compared to 180 pound feet for the same joint sheathed. Similarly the multiple nail plate spliced joint showed a resistance of 36,000 pounds in tension as compared to 35 pounds for a similar joint bridged by a tubular sheath, thus providing for efficient extraction of spliced piling without separating the joint sections. The invention enables speedy accurate manipulation and attachment of the multiple nail plates in situ.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A splicing machine for applying fasteners for joining together wooden members, said machine comprising a frame, two side by side lever arms each arm being pivotally coupled to said frame at a location intermediate its ends, said lever arms having releasable fastener mounting means on one pair of adjacent ends for holding fasteners to be driven into the wooden members and having the other pair of adjacent ends operably connected to a motor mounted on said frame, said motor being a fluid pressure motor having a reciprocable output rod connected by toggle link means to said other pair of ends of said lever arms and being capable of being actuated for rocking both arms between one position wherein said one pair of adjacent ends is separated for mounting the fasteners thereon and another position wherein the arms are rocked to drive said fasteners into the wooden members disposed between them, said lever arms having longitudinally grooved and ribbed inner sides facing each other and said frame being correspondingly interfittingly grooved and ribbed so that said arms are strengthened against forces acting perpendicular to the pivot axis of said lever arms, said rod of said motor being fixed to a multiple clevis member presenting alternate grooves and ribs, said clevis member being connected to said other pair of ends of said arms by associated pivoted toggle links, said toggle links being interleaved with said ribs of said clevis member and extending between the clevis member and each arm and said fastener mounting means maintaining such fasteners to be driven into the wooden members in a substantially parallel relationship and said fastener mounting means including opposed platens mounted for limited rocking on said one pair of lever arm ends and being able to transmit the driving force for driving the fasteners into the wooden members.

2. The machine defined in claim 1 wherein said fasteners are metal multiple nail plates and said fastener mounting means comprise magnets.

3. The machine defined in claim 1 wherein said lever arms are of equal effective length and rock about parallel axes.

4. The machine defined in claim 1 wherein mounting loops are provided on said arms whereby the machine may be suspended and made readily portable for accurate locations during operation.

5. The machine defined in claim 1, wherein said fastener mounting means include magnetic means imbedded in surfaces of said platens that face each other.

6. The machine defined in claim 5, wherein each of said platen faces is planar and said magnetic means comprises a pluarlity of permanent magnets imbedded in each platen at said faces and flush with the platen face.

* * * * *